United States Patent [19]

Jedrziewski

[11] Patent Number: 4,643,148

[45] Date of Patent: Feb. 17, 1987

[54] MECHANICAL OVERRIDE FOR ELECTRONIC FUEL CONTROL ON A PISTON ENGINE

[75] Inventor: Stanley T. Jedrziewski, Williamsport, Pa.

[73] Assignee: Avco Corporation, Williamsport, Pa.

[21] Appl. No.: 776,691

[22] Filed: Sep. 16, 1985

[51] Int. Cl.[4] ..... F02D 41/22

[52] U.S. Cl. ..... 123/376; 123/396; 123/400; 123/198 D; 74/479; 74/625

[58] Field of Search ..... 123/376, 396, 397, 400, 123/198 D; 74/479, 625

[56] References Cited

U.S. PATENT DOCUMENTS

| | | | |
|---|---|---|---|
| 3,120,845 | 2/1964 | Horner | 74/625 |
| 3,292,453 | 12/1966 | Recknagel | 74/625 |
| 4,401,077 | 8/1983 | Earl | 123/376 |
| 4,548,176 | 10/1985 | Ishida et al. | 123/396 |

*Primary Examiner*—William A. Cuchlinski, Jr.

*Attorney, Agent, or Firm*—Robert J. McNair, Jr.; Irwin P. Garfinkle

[57] ABSTRACT

This invention discloses apparatus for controlling the throttle of an aircraft engine so that it is either in the fully automatic electronic fuel control mode or in the completely manual mode while using a single throttle lever. In the event of a power failure in the aircraft, automatic reversion to the manual throttle control mode of operation is provided. The apparatus for achieving this consists of an outer housing shell having a lever arm extending radially therefrom, the outermost end of the lever arm being pinned to a source of translational motion such as provided by a push rod attached to the manual throttle lever. Within one end of the outer housing shell there is an output spool having on its outward facing end a boring sized to accommodate the throttle shaft of the engine fuel metering system. An input spool is mounted for rotation within the second end of the outer housing shell. The outward facing end of the input spool is secured by a shaft to the electronic fuel control equipment. An electrically powered solenoid mounted on the outer housing shell so that its plunger faces radially inward interfaces with a spring loaded transverse pin within the apparatus to selectively lock the rotation of the output spool to the rotation of the input spool for providing control of the throttle by the automatic fuel control equipment. Loss of aircraft electric power or deactivation of the solenoid automatically locks the output spool to the outer housing shell thereby enabling manual throttle control.

6 Claims, 10 Drawing Figures

FIG. 7
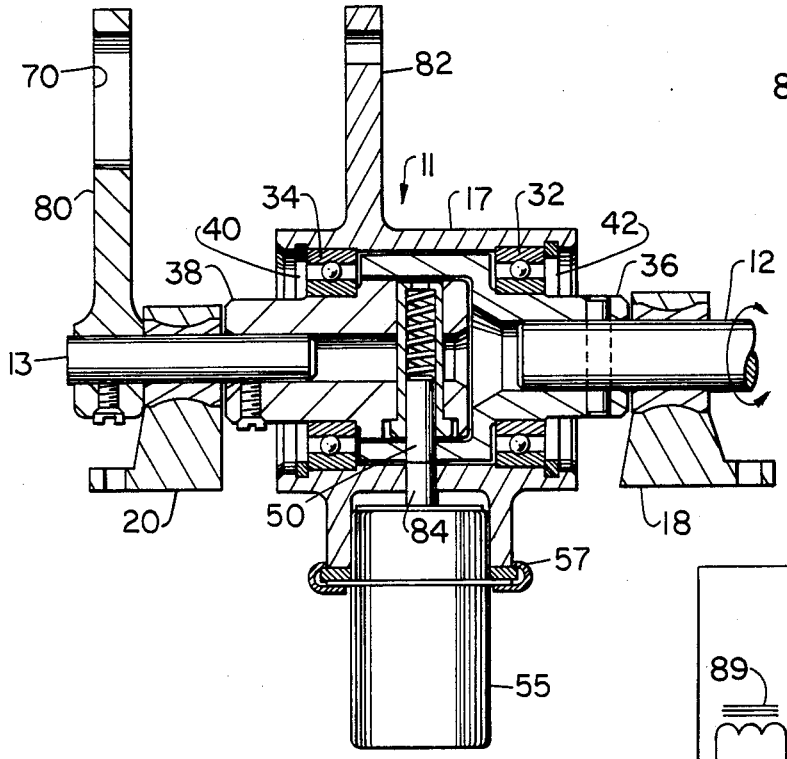
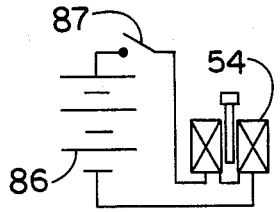
FIG. 9A
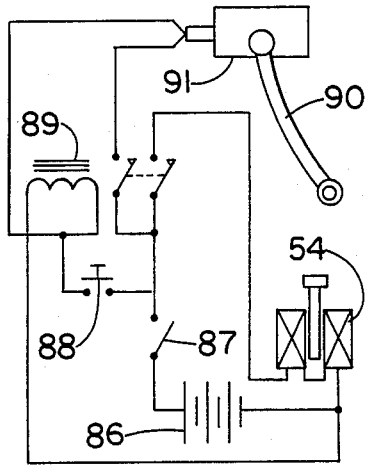
FIG. 9B
FIG. 8
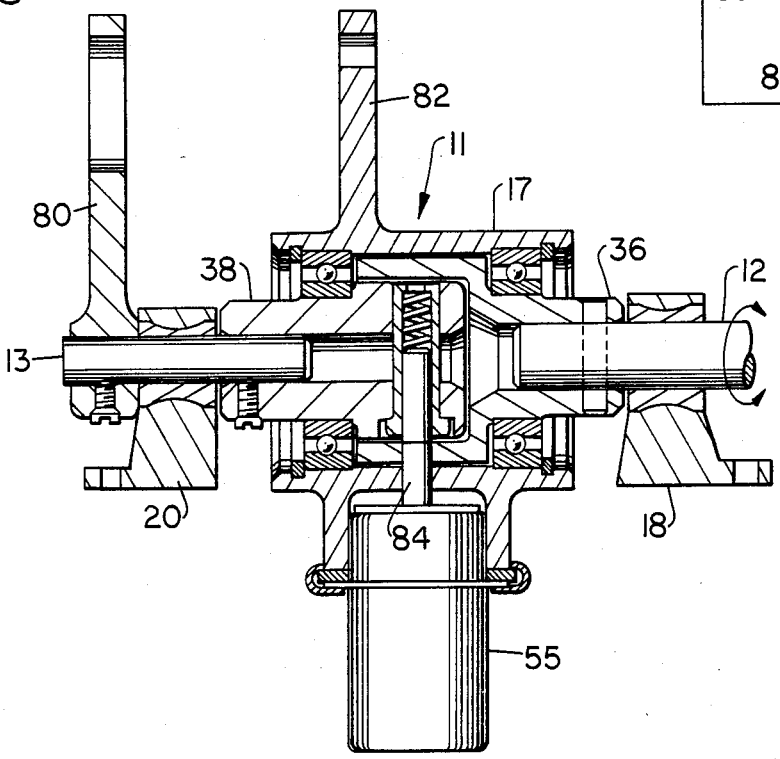

MECHANICAL OVERRIDE FOR ELECTRONIC FUEL CONTROL ON A PISTON ENGINE

BACKGROUND OF THE INVENTION

This invention provides means for the pilot of a piston engine airplane to take manual control of the throttle when an electrical failure causes the electronic fuel system to malfunction.

The fuel system of an airplane can be divided into two parts, namely, the aircraft portion and engine portion. The aircraft portion includes the fuel tanks, the fuel booster pumps, the fuel drains, the fuel lines, the gages, the vents and filler caps, and the flow selector valves. The engine portion of the fuel system includes all the fuel controlling units between the engine driven pump supplied from the fuel lines and the point where fuel-air charge is fed into the engine cylinders. This includes the fuel flow control units and the carburetor or other fuel metering device. This invention is part of the engine fuel system.

The various ways that the fuel-air charges are prepared and delivered to the cylinders of an aircraft type piston engine are explained in the text authored by R. D. Bent and J. L. McKinley, titled *Aircraft Powerplants,* Fourth Edition, published 1978 by the Gregg Division of McGraw-Hill Book Co. This text covers basic fuel systems and both float-type and pressure injection carburetors. Fuel-injection systems are also discussed.

As explained on page 72 of the above referenced text . . . carburetors used on aircraft engines are comparatively complicated because they play an extremely important part in engine performance, mechanical life, and the general efficiency of the airplane. This is caused by the widely diverse conditions under which airplane engines are operated. The carburetor must deliver an accurately metered fuel-air mixture for engine loads and speeds between wide limits and provide for automatic or manual mixture correction under changing conditions of temperature and altitude. (The carburetor)...is subjected to continuous vibration that tends to upset the calibration and adjustment.

Most carburetors have a throttle valve incorporated in the fuelair duct either upstream or downstream of the main fuel discharge nozzle. The throttle valve is usually an oval-shaped metal disk mounted on the throttle shaft in such a manner that it can completely close the throttle bore. In the closed position, the plane of the disk makes an angle of about 70 degrees with the axis of the throttle bore. The edges of the throttle disk are shaped to fit closely against the sides of the fuel-air passage. The amount of air flowing through the venturi tube is reduced when the valve is turned toward its closed position. This reduces the suction in the venturi tube, so that less fuel is delivered to the engine. When the throttle valve is opened, the flow of the fuel-air mixture to the engine is increased. Opening or closing the throttle valve thus regulates the power output of the engine.

The goal with all carburetors whether of the float types or the pressure injection types is to automatically and accurately meter the fuel at all engine speeds and loads regardless of changes in altitude, propeller pitch, or throttle position. Recent innovations have brought about the development of electronic fuel control systems to better accomplish the automatic fuel metering task. This is fine except when a catastrophic failure occurs in the electrical system of the aircraft. For such a failure, improbable as such an occurrence might be, means must be found to allow the airplane pilot to take manual control of the engine throttle when there is a malfunction in the electronic system. My invention does this.

SUMMARY OF THE INVENTION

A single lever throttle control system is disclosed for operating an aircraft piston engine in either the fully automatic electronic mode or in the completely manual mode. In the event of an electrical power failure in the aircraft, manual throttle control is readily established. The unit that accomplishes this couples to the throttle shaft of the engine carburetor or for engines not using carburetors the throttle valve shaft.

The uniqueness of the unit is that it permits the use of either of two input motions to control the rotational position of the throttle shaft. One of the possible inputs is rotational movement of a shaft powered by a stepping motor actuated by the electronic fuel control apparatus. The second type of input is the translational motion of a push rod or push-pull cable actuated by manually positioning the throttle lever of the aircraft. The choice as to which of the two input motions actuate the engine throttle shaft may be controlled by either the airplane pilot or by an automatically operated mechanism.

The essential features of the throttle control unit are five-fold. There is an outer housing shell having a cylindrical shaped interior. A lever arm extends from the periphery of the outer housing shell. The outermost end of the lever arm is pinned to the source of translational motion which is derived from manually positioning the throttle lever in the cockpit of the airplane.

Secondly, there is an output or driven spool having a generally cylindrical body sized to rotate freely within the outer housing shell. An annular bearing, for example, a ball bearing race, may be used to facilitate free rotation, yet provide support, between the output spool and the outer housing shell. The output spool has an overall length which is approximately two thirds that of the cylindrical interior portion of the outer housing shell. Along the centerline of the output spool is a boring sized to receive the end of the throttle shaft as it extends outwardly away from the wall of the engine carburetor or equivalent.

Third, there is an input or driver spool having a generally cylindrical body sized to rotate freely within the second end of the outer housing shell. The innermost end of the input spool has a diameter which is smaller than that of the output spool allowing it to fit within a cup shaped annulus formed in the inward facing end of the output spool. A second ball bearing race may be used to facilitate easy rotation of the input spool with respect to the outer housing shell. Along the centerline of the input spool is a boring sized to receive the output shaft of the stepping motor of the electronic fuel control. Axial alignment of the input and output shafts is maintained.

Adjacent the innermost end of the input or driver spool there is a boring formed transverse to the spool axis. This boring contains a spring loaded pin sized to slide freely in the transverse boring. An opening through the inner cup shaped skirt of the output or driven spool allows the spring loaded pin to snap outward locking the output and input spools together for one specific rotational orientation of the two spools. An appropriately positioned opening in the outer housing shell allows the spring loaded pin to move further outward for the condition where the two spools rotate to the position where the openings are aligned with the opening in the outer shell. Now all three components are locked together.

A fifth component is now added, namely, a solenoid. The solenoid is attached to the outer housing shell such that the plunger along the central axis of the solenoid moves radially in and out of the transverse opening formed in the housing wall. In its activated condition, the solenoid plunger extends only far enough into the opening in the housing shell to be flush with the inner cylindrical surface. This condition allows the stepping motor driven input spool to completely control the output spool and hence the engine throttle valve. When the solenoid coil is deactivated, the plunger retracts into the body of the solenoid. This makes it possible for the transversely mounted pin to drop into the opening in the outer shell, thereby locking the two spools and the outer housing shell together. Manual throttle control now is possible with the pilot in command. Configured in this way, the system is fail safe since an electrical failure will cause the solenoid to deactivate, thereby allowing the pilot to take control of engine speed by merely grabbing the throttle lever. At all times the choice of using manual or automatic control is under pilot jurisdiction.

BRIEF DESCRIPTION OF THE DRAWINGS

FIG. 7 is a cross sectional view of an alternate implementation of the invention wherein the input spool is locked to the output spool.

FIG. 8 is a cross sectional view of the implementation shown in FIG. 7 wherein the outer shell is locked to the output spool.

FIG. 9A is a circuit diagram of one means of energizing the solenoid.

FIG. 9B is a circuit diagram of an alternate means of energizing the solenoid.

DESCRIPTION OF THE PREFERRED EMBODIMENT

Figure 1:
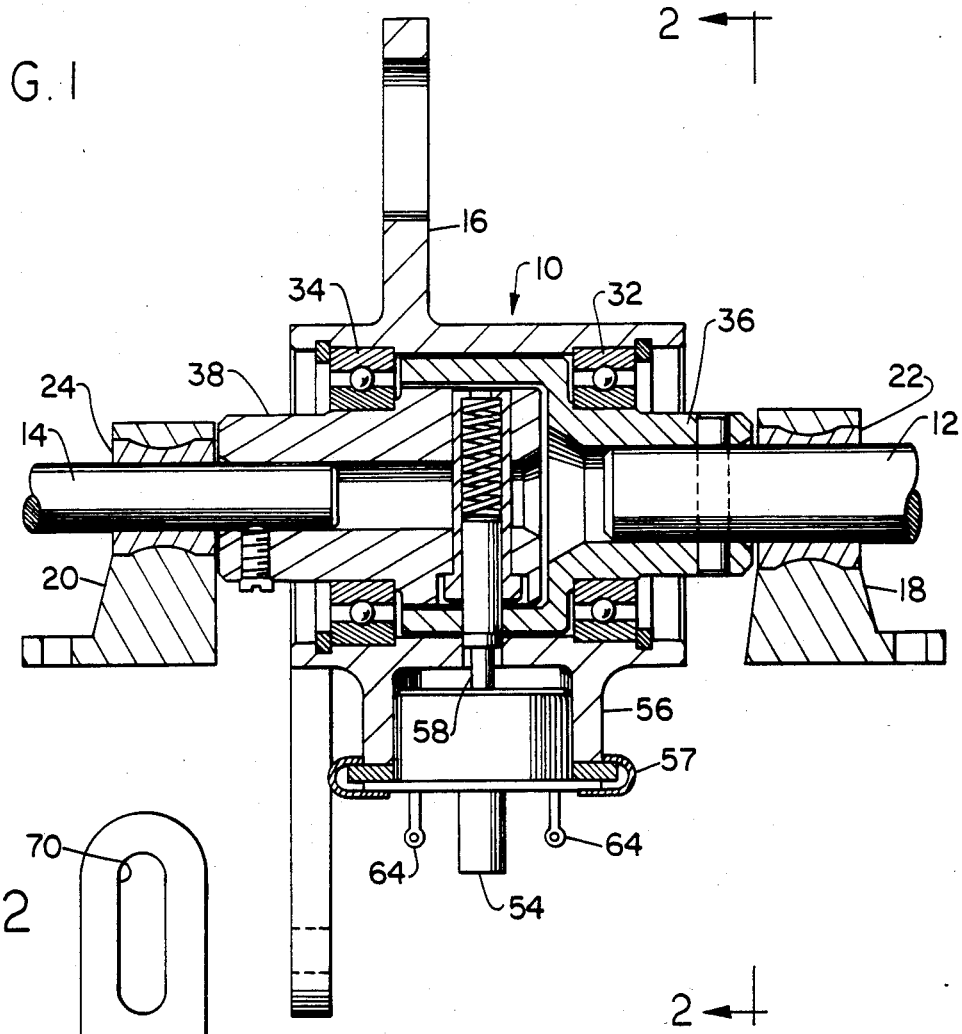
FIG. 1 is a cross sectional view of the two input throttle control unit.

FIG. 1 shows the throttle control system which provides both a manual throttle control input and an automatic type of input from a stepping motor. The throttle control 10 of FIG. 1 provides an output on shaft 12 and an input on either shaft 14 or control lever 16. The input on shaft 14 is rotational from a stepping motor (not shown) that is actuated by the electronic fuel control apparatus. The second type of input on control lever 16 is translational from either a push rod or push-pull cable manually positioned by the throttle lever of the aircraft. The throttle control 10 is supported by shafts 12 and 14 which are rotationally mounted on support brackets 18 and 20 respectively. Support brackets 18 and 20 will be appropriately attached to the aircraft engine whose throttle is being controlled. Support bracket 18, has a lubricated bearing 22 which allows rotation of shaft 12 at a low friction level. Bearing 24 provides a similar function for shaft 14.

Figure 4:
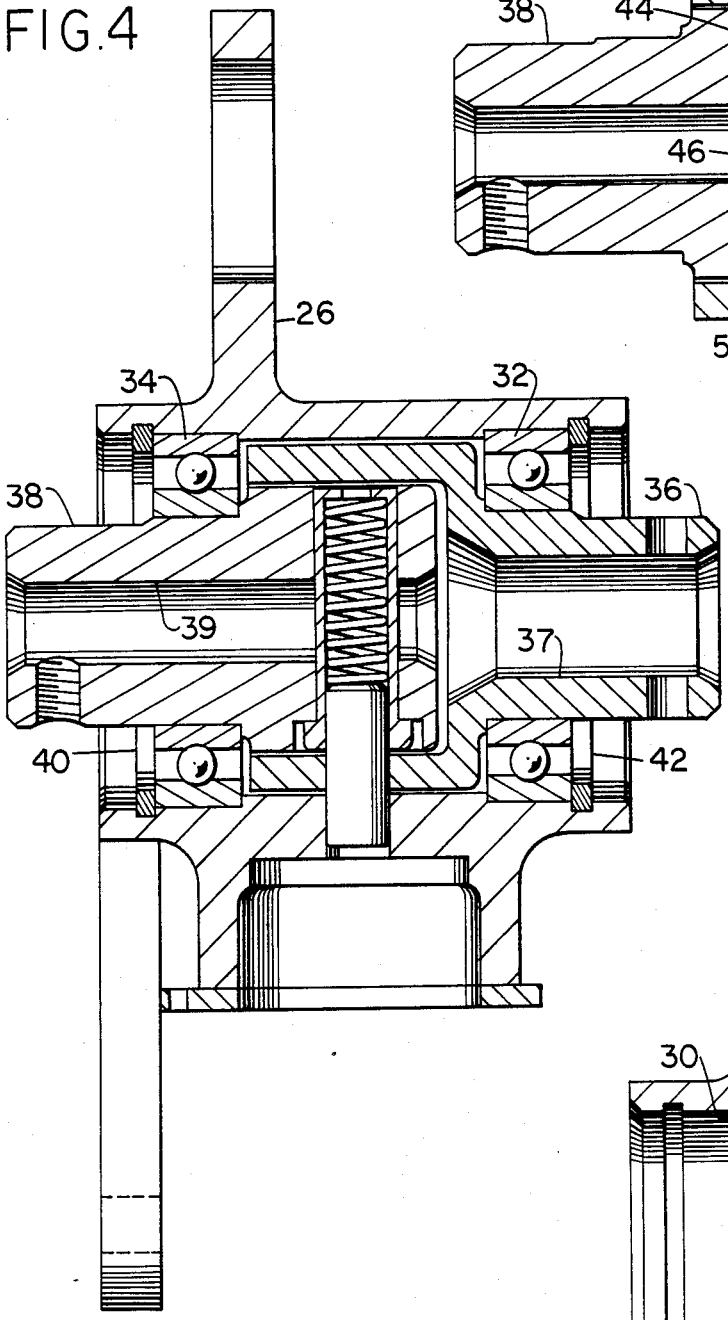
FIG. 4 is an enlarged cross sectional view of the throttle control unit showing the input spool, the output spool and the outer shell all pinned together.
Figure 5:
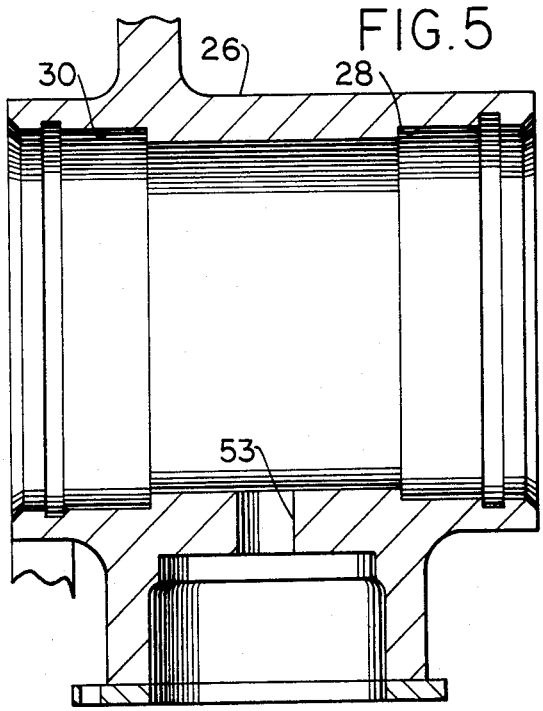
FIG. 5 is a cross sectional view of the outer housing shell.

Throttle control 10 includes an outer housing shell 26 (see FIG. 5). Housing shell 26 has a generally cylindrical shaped interior. Lands 28 and 30 adjacent the right and left hand ends of the housing shell 26 allow the placement of ball bearing races 32 and 34 (see FIG. 4). Ball bearing race 32 supports output spool 36 having a generally cylindrical body, sized to rotate freely within outer housing shell 26. The output spool has an overall length which is approximately two-thirds that of the outer housing shell 26. Along the centerline of output spool 36 is a boring 37 sized to accept the end of the throttle shaft as it extends outwardly away from the wall of the engine carburetor. The outwardly extending throttle shaft is shown as output shaft 12 in FIG. 1.

Nesting within the cup shaped annulus on the innermost end of spool 36 is an input spool 38. Input spool 38 is supported within outer housing shell 26 by means of bearing race 34. Along the centerline of input spool 38 is a boring 39 sized to receive the output shaft of the stepping motor of the electronic fuel control equipment. This shaft is designated input shaft 14 in FIG. 1. The input spool 38 is held in position within outer shell 26 by C-ring 40. Similarly, output spool 36 is held in position within outer shell 26 by means of C-ring 42.

Figure 6:
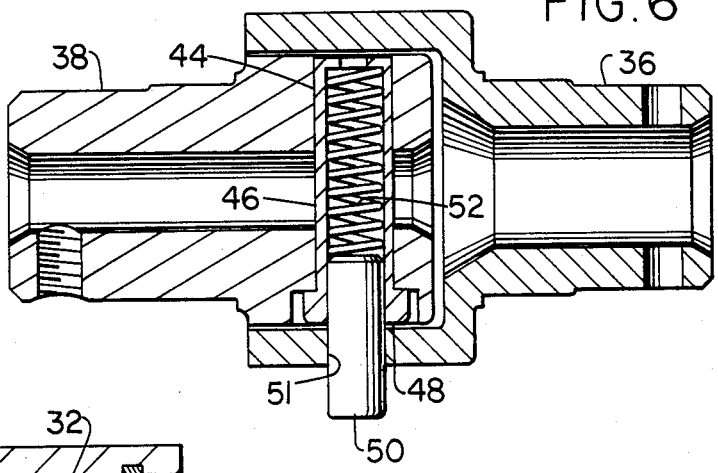
FIG. 6 is a cross sectional view of the input and output spools.

FIG. 6 shows input spool 38 nested within the cup shaped annulus of output spool 36. Adjacent the innermost end of input spool 38 is a boring 44 formed transverse to the axis of the spool. Boring 44 has mounted therein a pin holder 46 comprising a cylindrical shell having a lip 48. Within the shell is a spring loaded pin 50 which tends to slide radially outward under the force of spring 52. An appropriately positioned opening 51 in output spool 36 allows the spring loaded pin 50 to move outward when input spool 38 and output spool 36 are properly aligned. This locks the input and output spools together.

Additionally, there is an opening 53 formed in outer housing shell 26 (see FIG. 5) which is positionally aligned so that pin 50 can move further outward for the condition where the two spools rotate to provide alignment with the opening in the outer shell. Now all three components are locked together as shown in FIG. 4.

Figure 3:
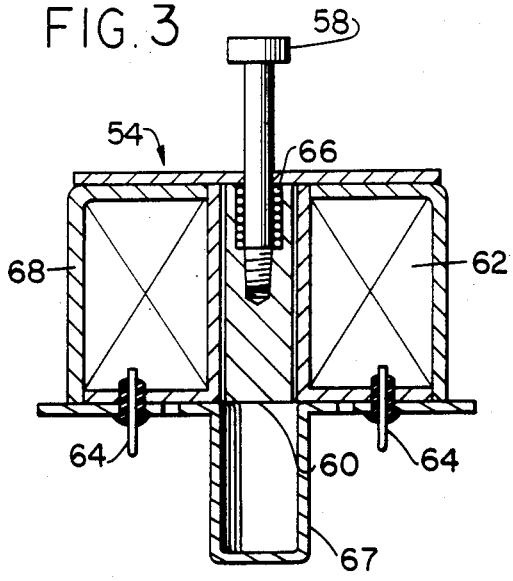
FIG. 3 is a cross sectional view of the solenoid.

Whether pin 50 penetrates through opening 53 of outer housing shell 26 is determined by the action of solenoid 54 (see FIGS. 1 and 3). Solenoid 54 attaches to a fitting 56 on the outer surface of housing shell 26 by means of clamp 57. Attachment is such that the solenoid plunger 58 can penetrate inwardly into opening 53. In its activated condition solenoid 54 forces plunger 58 into opening 53 such that the outwardmost end of the plunger is aligned with the inner surface of housing shell 26. Thus in its activated condition, solenoid 54 prevents pin 50 from locking the input and output spools to the outer housing shell. Thus when the solenoid is activated the input spool 38 and output spool 36 move in unison but are completely independent of movement of outer housing shell 26.

An enlarged cross sectional view of the solenoid is shown in FIG. 3. Plunger 58 is formed of a non-magnetic material inserted as by threads into magnetic core 60. A core winding 62 accessible by connector pins 64 serve to activate the solenoid when electric power is applied. The activated state of the solenoid is depicted in FIG. 3. When the electric current is turned off the plunger relaxes from the state shown in FIG. 3 and a coiled spring 66 causes the magnetic core to retract downward into case 67. For the relaxed state of the solenoid 54, pin 50 will snap down into the outer housing opening 53. This position of pin 50 causes the outer housing 26 and output spool 36 to be locked together such that motion of the outer housing 26 causes identical motion of the output spool. This state allows the aircraft pilot to be in manual command of the throttle.

The solenoid case 68 is formed of a magnetic material such as sheet steel. On application of electric power to coil winding 62, magnetic core 60 will snap upward to the position shown in FIG. 3 such that it closes the air gap at the upper end of the case. FIG. 9A shows one means of applying electric power to solenoid 54. A battery 86 which may be the prime power supply of the aircraft is encircuited across the coil winding of solenoid 54 and manual SPST switch 87 moved to the closed position. With switch 87 moved to the closed position, magnetic core 60 (See FIG. 3) will snap upward, remaining in that position until switch 87 is opened or the source of prime power fails.

Manual throttle linkage is connected to outer housing shell 26 via slot 70 positioned near the outermost end of the lever arm 16 extending from the periphery of the housing shell. In the unit reduced to practice an optional second lever arm 74 is incorporated into the outer housing shell 26 in the manner shown in FIG. 2. Thus when the translational movement of the manual throttle control occurs auxiliary arm 74, moving as depicted by arrows 72 provides control of other engine functions.

Figure 2:
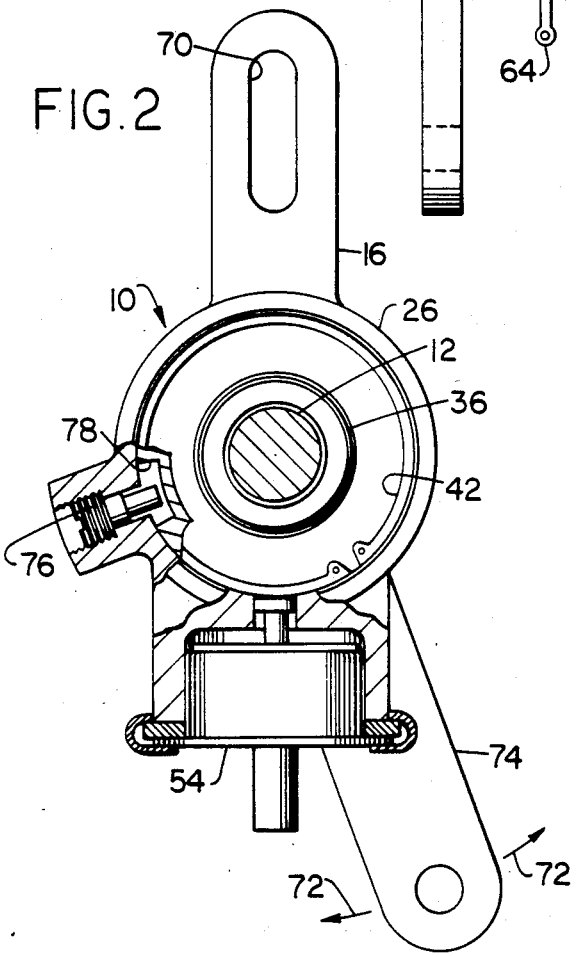
FIG. 2 is an end view partially cutaway of the throttle control unit taken along line 2—2 of FIG. 1.

Also shown in the cutaway view on the left side of FIG. 2 is a device consisting of pin 76 and slot 78 which limits the relative travel of the outer housing shell 26 and output shell 36. This feature prevents the electronic fuel control operating through shaft 14 from advancing or retarding the throttle via shaft 12 over an appreciable range without causing the manual throttle linkage to follow. In this way the pilot will be readily able to assume manual control in case of a catastrophic electrical failure in the aircraft.

FIGS. 7 and 8 show an alternate implementation of the invention. Throttle control system 11 provides an output on shaft 12 and an input on either shaft 13 or control lever 82. The input on shaft 13 is by means of control lever 80. In this implementation both inputs are translational from either a push rod or a push-pull cable. Throttle control system 11 is supported by shafts 12 and 13 which are rotationally mounted on support brackets 18 and 20. Support brackets 18 and 20 will be appropriately attached to the aircraft engine whose throttle is being controlled.

In this alternate implementation, output spool 36 and input spool 38 are identical with those described earlier with respect to FIGS. 1–6. Output spool 36 and input spool 38 are assembled within outer housing shell 17. Adjacent the innermost end of input spool 38 is the same pin holder mounted transverse to the axis of the spool. A spring loaded pin 50 slides radially outward as previously described.

In this implementation the electronic fuel control system will actuate lever 82. The manual throttle control will be connected to lever arm 80 via slots 70 configured similar to that shown in FIG. 2. Solenoid 55 which is attached to outer housing shell 17 by means of clamp 57 operates differently than the system of FIGS. 1–6. The relaxed state of solenoid 55 will have the plunger positioned as shown in FIG. 7. As depicted in FIG. 7, pin 50 locks input spool 38 to output spool 36 since the plunger 84 of solenoid 55 extends flush to the inner surface of outer housing shell 17. Therefore, for the conditions shown in FIG. 7, the manual throttle control operating via lever 80 will be in complete control of the throttle via throttle shaft 12. Lever 82 whose position is derived from the electronic fuel control equipment is completely disconnected from control of the throttle.

FIG. 8 shows the activated condition of the solenoid 55. In this condition the plunger 84 extends an amount sufficient to force pin 50 back to a condition where it is wholly within input spool 38. This locks outer housing shell 17 and output spool 36 together while at the same time disconnecting the manual throttle control. Thus, for the alternate implementations of FIGS. 7 and 8, it is possible to operate the aircraft engine either by means of the manual throttle lever or by means of the electronic fuel control. Failure of the aircraft electronics deactivates solenoid 55, causing pin 50 to snap outward and allow engagement of the manual throttle.

FIG. 9B shows an alternate means for applying electric power to solenoid 54. In the FIG. 9B implementation, the solenoid will deactivate when the pilot takes control by grasping and moving manual throttle control lever 90. This is accomplished as follows. Activating switch 87 is closed. Push button switch 88 is then depressed, energizing relay 89. Once energized, the relay contacts will close. The relay contact shown furthest from the core will complete the circuit for solenoid 54. The second relay contact, shown nearest the core, acts as a holding circuit in combination with the normally closed switch contacts within unit 91. Thus, once push button switch 88 acts to close the contacts of relay 89, solenoid 54 will remain energized after push button switch 88 is released. However, when the pilot of the aircraft wishes to assume manual control of the throttle, he does so by grasping and initiating movement of throttle lever 90. Any movement of throttle lever 90 initiates a change in pressure within unit 91. This change in pressure causes the normally closed switch contacts that are a part of the holding circuit to temporarily open. This lets relay 89 change to the open circuit state causing solenoid 54 to deactivate. When the flight emergency is over, the pilot can reinstitute the automatic fuel control system by depressing push button switch 88. Manual control of the throttle does not require that the pilot remember to actuate a switch sequence. He assumes control when he moves throttle lever 90.

While there has been shown and described what is at present considered to be the preferred embodiments of the invention, it will be obvious to those skilled in the art that various changes and modifications may be made therein without departing from the true scope of the invention as defined in the appended claims.

I claim:

1. Apparatus for controlling the throttle of a fuel burning engine from either a shaft powered by automatic fuel control equipment or by the translational motion of a manually positioned throttle lever, said apparatus being attached to said engine via a throttle shaft extending outwardly from the wall of the engine fuel-air metering system, said apparatus comprising:

an outer housing shell having a generally cylindrical interior and a lever arm rigidly attached to and extending radially away from the periphery thereof, the lever end furthest from the periphery of said outer housing shell being pivotally connected to said manual throttle lever;

an output spool mounted for rotation within one end of said outer housing shell, said output spool having an axial boring at its outermost end sized to receive and be secured to said throttle shaft, the inward facing end of said output spool being coaxially formed into a cup shaped annulus;

an input spool having a generally cylindrical shape, said input spool mounted for rotation within the second end of said outer housing shell, the innermost end of said input spool being sized to fit within the cup shaped annulus on the inward facing end of said output spool, the input spool having an axial boring at its outermost end sized to receive and be secured to a shaft powered by said automatic fuel control equipment;

a spring loaded pin sized to slide freely in a boring formed transverse to the axis of said input spool adjacent its innermost end, said spring being compressed when said pin is fully within said input spool;

an opening formed in the cup shaped portion of said output spool, said opening being positioned and sized to allow said spring loaded pin to slide outward locking said input and output spools together for one specific orientation thereof;

an opening formed in said outer housing shell, positionally in alignment with the transverse boring in said input spool, allowing said spring loaded pin to rotationally lock together said input spool, said output spool and said outer housing shell for one specific orientation of each; and a solenoid having a plunger along its central axis, the solenoid being attached to said outer housing shell such that said plunger moves in and out of the opening formed in said housing wall, the activated state of said solenoid preventing said spring loaded pin from locking said outer housing shell to said output spool.

2. The apparatus as defined in claim 1 wherein the spring loaded pin is seated in a pin holder comprising a cylindrical shell having a lip, said pin holder being inserted in the transverse boring of said input spool.

3. The apparatus as defined in claim 1 and including a pin mounted in said outer housing shell so as to project inward into a slot in said output spool for limiting the relative travel of the output spool with respect to the outer housing shell.

4. Apparatus for selecting whether the throttle valve of an aircraft engine is to be controlled by commands generated in automatic fuel control equipment or by a manually positioned throttle lever, said throttle valve control being accomplished by rotatably positioning a throttle shaft extending from the wall of the engine fuel metering system, electrical system failure in said aircraft causing automatic switchover to manual throttle control, said apparatus comprising:

an outer housing shell having a generally cylindrical interior, the periphery of the outer housing shell having a lever arm attached thereto and extending outwardly therefrom, the outermost end of said lever arm being pinned to a source of translational motion representative of manual throttle parameters;

an output spool mounted for rotation in one end of said outer housing shell, the outward facing end of said output spool being secured to the throttle shaft of said engine;

an input spool mounted for rotation in the second end of said outer housing shell, the outward facing end of said input spool being secured to a shaft whose angular position changes in response to throttle settings generated by automatic fuel control equipment; and solenoid actuated means for selectively positioning to either of two states a spring loaded pin seated within and transverse to the axis of said input spool, the energized state of said solenoid serving to position said pin for rotationally locking said output spool to operate in unison with said input spool, thereby controlling the engine throttle by the automatic fuel control equipment, switching off or loss of electric power to said solenoid actuated means causing the movement of said pin to the alternate state to accomplish lockup of said output spool with said outer housing shell therefore causing engine control to revert to the manual throttle mode.

5. Apparatus for selecting whether the throttle valve of an aircraft engine is to be controlled by commands generated in automatic fuel control equipment or by a manually positioned throttle lever, said throttle valve control being accomplished by rotatably positioning a throttle shaft extending from the wall of the engine fuel metering system, electrical system failure in said aircraft causing automatic switchover to manual throttle control, said apparatus comprising:

an outer housing shell having a central axis and a generally cylindrical interior, said outer housing shell including means for accomplishing rotational movement around its axis in response to changing settings of said manually positioned throttle lever;

an output spool mounted for rotation in one end of said outer housing shell, the outward facing end of said output spool being secured to the throttle shaft of said engine;

an input spool mounted for rotation in the second end of said outer housing shell, the outward facing end of said input spool being secured to a shaft whose angular position changes in response to throttle settings generated by automatic fuel control equipment;

a spring loaded pin sized to slide freely in a boring formed transverse to the axis of said input spool adjacent its innermost end, said spring being compressed when said pin is fully within said input spool;

an opening formed in the cup shaped portion of said output spool, said opening being positioned and sized to allow said spring loaded pin to slide outward locking said input and output spools together for one specific orientation thereof;

an opening formed in said outer housing shell, positionally in alignment with the transverse boring in said input spool, allowing said spring loaded pin to rotationally lock together said input spool, said output spool and said outer housing shell for one specific orientation of each;

a solenoid having a coil winding and an extendable spring loaded plunger, said solenoid being attached to said outer housing shell such that said plunger when extended moves inwardly through the opening formed in said outer housing shell; and a source of electrical power for energizing the coil winding of said solenoid, the energized state of said coil winding positioning said plunger so as to prevent said spring loaded pin from locking said outer housing shell to said output spool, while loss of electrical power to said coil winding causes said plunger to retract thereby allowing said spring loaded pin to advance such that said outer housing shell is automatically locked to said output spool to provide manual throttle control.

6. The apparatus as defined in claim 5 and including a pin mounted in said outer housing shell so as to project inward into a slot in said output spool for limiting the relative travel of the output spool with respect to the outer housing shell.

* * * * *